United States Patent [19]

Niemela

[11] 4,074,448

[45] Feb. 21, 1978

[54] HINGED SNOWPLOW, CONVERSION KIT, AND METHOD THEREFOR

[76] Inventor: W. Wally Niemela, Box 165E, Chassell, Mich. 49916

[21] Appl. No.: 697,037

[22] Filed: June 17, 1976

[51] Int. Cl.[2] ..... E01H 5/00

[52] U.S. Cl. ..... 37/41; 37/42 VL; 37/44; 37/46; 37/195; 172/805

[58] Field of Search ..... 37/41, 42 R, 42 VL, 37/44, 46, 49, 50, 30, 195; 172/802–806, 791, 792, 796, 777, 784

[56] References Cited

U.S. PATENT DOCUMENTS

| | | | |
|---|---|---|---|
| 574,567 | 1/1897 | Pepin | 37/46 |
| 2,059,431 | 11/1936 | Barrett et al. | 172/804 |
| 2,218,512 | 10/1940 | Ball | 37/42 R |
| 2,869,254 | 1/1959 | Weeks | 37/42 |
| 3,157,099 | 11/1964 | Ulrich | 37/44 X |
| 3,201,878 | 8/1965 | Markwardt | 37/42 R |
| 3,250,026 | 5/1966 | Jocher et al. | 37/42 R |
| 3,645,340 | 2/1972 | Frisbee | 172/804 |
| 3,775,877 | 12/1973 | Gove, Sr. | 37/42 VL |
| 3,803,733 | 4/1974 | Ramsey | 37/44 |
| 3,807,064 | 4/1974 | Schmidt, Jr. | 37/50 X |

FOREIGN PATENT DOCUMENTS

| | | | |
|---|---|---|---|
| 482,779 | 4/1952 | Canada | 37/42 R |
| 2,022,238 | 11/1970 | Germany | 37/42 R |
| 1,097,463 | 5/1953 | Germany | 37/42 VL |
| 323,974 | 12/1971 | Sweden | 37/44 |

*Primary Examiner*—E. H. Eickholt

*Attorney, Agent, or Firm*—Price, Heneveld, Huizenga & Cooper

[57] ABSTRACT

The specification discloses a snowplow for vehicles including a central, generally vertically extending hinge having blade sections on either side allowing the plow to be positioned in a forwardly projecting V shape, a recessed cupped shape, or angled to either side or laterally across the width of the vehicle. The hinge and blade sections are supported by a vertically extending hinge support member secured to and tapering toward the support frame from above and below the support frame. Means on the rear of the blade sections provide contacts or stops limiting rearward pivoting of the blades. Apparatus for laterally extending the blades as well as for horizontally hinging the vertically hinged blade to avoid obstacles during plowing is included. Also disclosed are a kit and method for converting a rigid, elongated snowplow to the said hinged snowplow.

51 Claims, 23 Drawing Figures

HINGED SNOWPLOW, CONVERSION KIT, AND METHOD THEREFOR

BACKGROUND OF THE INVENTION

This invention relates to vehicular snowplows and, more particularly to a hinged snowplow which can be positioned to clear paths through deep snow, to push snow without spilling snow to either side of the vehicle, or to clear snow to either side of the vehicle. The invention also relates to a conversion kit and method for converting snowplows having rectilinear plow blades to those including hinged plow blades.

A common problem encountered with vehicular snowplows and especially plows with elongated, rectilinear blades adapted for use lighter vehicles such as pickup trucks, jeeps, and other personally owned vehicles, has been the inability of such plows to adapt to various snow-clearing needs. The word "rectilinear" is used to refer to blades having straight ground or surface engaging edges although the vertical cross section of the blade may be curved or straight. With existing rectilinear snowplows, snow may be cleared only to one side of the vehicle or to the other. When the blade is positioned across the front of the vehicle, the weight of the snow, especially if it is heavy wet snow, often makes the clearing of paths straight ahead difficult. Moreover, when a pile or mass of snow must be pushed to an out-of-the-way location such as when clearing parking lots and the like, prior snowplows have allowed snow to spill to one side of the vehicle or the other.

In recognition of the above problems, various types of hinged snowplows have been developed which allow lateral blade sections to be positioned in a forwardly extending V or in a recessed, cupped position for pushing snow. Typically, however, such hinged snowplows have included complex, complicated, and bulky mechanisms for hinging the various blade sections together to enable positioning of the blades in the above-mentioned positions. Moreover, such mechanisms have often been susceptible to break-down and have generally suffered from a lack of durability due to severe weather conditions and heavy loads.

An accompanying problem with many of the prior known hinged snowplow structures has been their inability to yield to fixed obstacles such as posts, rocks, or other projections extending from the surface being cleared of snow. If such an obstacle were struck with many of the prior structures, severe damage to the blade or the hinged structure or both would be sustained.

Additionally, the clearing of areas of snow substantially larger than the width of the clearing vehicle has been time consuming and difficult. While prior structures have been devised for providing extensions for the ends of existing plows, such structures have also been complicated, expensive, and suffered from a lack of durability.

Yet another problem encountered with snowplows is the expense in converting to use of a hinged plow from a more standard rectilinear rigid plow blade. Prior to the present invention, it has been necessary to completely remove the rigid plow and substitute a completely different hinged unit. The present invention is adapted to provide a simple, yet effective apparatus and method for converting a standard rectilinear plow blade to a hinged blade unit.

SUMMARY OF THE INVENTION

Accordingly, the present invention provides a hinged snowplow which overcomes the above problems simply and effectively. The invention also includes a kit and method for converting rectilinear plow units to hinged units.

The hinged snowplow includes a central, vertically extending hinge having a vertically extending hinge support member which engages and is secured to an outwardly extending support frame from a vehicle. The vertical support provides a simple yet durable support allowing a large degree of pivotal movement therearound when blade sections are secured on either side thereof. The vertically extending support member is secured to the support frame generally intermediate the top and bottom of the hinge and tapers toward the frame from above and below for added strength. When secured between two plow blade sections, the hinge structure allows the blades to be moved through greater degrees of movement than many of the prior known structures such that they can be positioned more effectively. The blades can be moved to a forwardly extending V shape for clearing paths through deep snow, a rearwardly recessed, cupped shape for pushing quantities of snow without spilling the same, rectilinearly and angled to either side of the vehicle or laterally straight across the front of the vehicle, or to positions intermediate these positions.

Blade positioning arms are pivotally secured between portions of the support frame and the rear of each of the plow blade sections. Means are included which engage or contact the support frame on either side of the hinge to limit rearward pivoting of the blade thereby greatly strengthening the load capacity of the hinged blades. The positioning arms themselves may be provided in manually extendible form or may include fluid cylinders for hydraulically positioning the blades. If single direction acting fluid cylinders are used, biasing springs for returning the blades rearwardly are included.

In yet other aspects of the invention, extension apparatus is provided for extending the length of plow blades, including those on either side of the central hinged structure disclosed herein, so that larger areas may be plowed. Such extension apparatus includes second or supplemental plow blades matching the contour of the basic blades and secured in overlying relationship thereto. The supplemental or secondary blades may be moved manually outwardly or slid outwardly as powered by fluid cylinders and returned by biasing springs or the fluid cylinders themselves in various embodiments.

In yet another aspect of the invention, the entire central hinge and plow blade sections are horizontally hinged to allow the entire hinge and blade unit to pivot upwardly to avoid fixed obstacles encountered during plowing which would otherwise damage the plow. Biasing means are included for returning the hinge and plow sections to their standard, vertically upright positions while the blade-positioning arms include universal connections to allow such pivoting.

In further aspects, the structure for providing the hinged snowplow blades may be provided in kit form such that existing rectilinear rigid snowplow blades may be converted to hinged units using templates for cutting the blades provided in the kit. The method includes marking the blades with the templates, cutting the same on either side of the blade center line, and securing the various hinge parts in proper position with respect to the vehicle supporting frame.

These and other objects, advantages, purposes, and features of the invention will become more apparent from a study of the following description taken in conjunction with the drawings.

DESCRIPTION OF THE PREFERRED EMBODIMENTS

Figure 1:
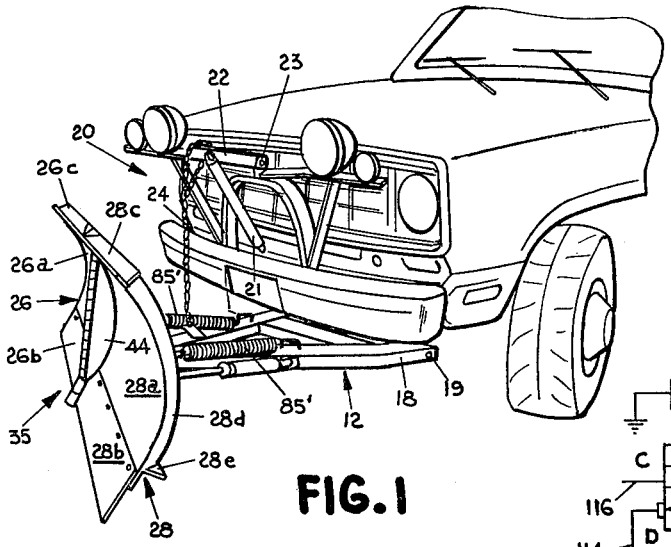
FIG. 1 is a perspective view of the hinged snowplow of the present invention secured to the front of a pickup truck.

Referring now to the drawings in greater detail, FIGS. 1–11 generally illustrate the basic embodiments of the present invention including the hinged structure and templates for converting a rigid, rectilinear snowplow blade to one of the hinged variety. FIGS. 12–17 illustrate another embodiment of the invention including extension apparatus for extending the lateral length of snowplow blades regardless of whether they are rectilinear, arcuate, or hinged. FIGS. 18–23 illustrate yet another embodiment of the hinged snowplow including a horizontal hinge for allowing the entire structure to tip forwardly to avoid obstacles encountered during plowing.

The present snowplow structure is designed for use with light vehicles such as pickup trucks, jeeps, or other utility vehicles. As shown in FIGS. 1–3 and 6–8, such vehicles typically include support frames hingedly secured to the front of a frame 11 for such a vehicle. In the present case, the hinged structure is designed for use with a generally triangular support frame 12 including converging side frame members 14 defining a generally horizontal apex 16 which extends outwardly in front of the vehicle. The support frame 12 may also include transverse bracing frame member 17 and pivot support members 18 which secure the frame 12 to a vehicular frame 11 by pivot pins 19.

Also included on the front of the vehicle is a lifting apparatus 20 for raising and lowering frame 12, and thus the plow supported at apex 16, about pins 19. Lifting apparatus 20 includes a hydraulic cylinder 21 for raising and lowering an arm 22 pivoted about point 23 and connected to the frame 12 by means of a vertically extending chain 24 secured to a chain support 15. Cylinder 21 may be powered from a hydraulic pump such as that shown in FIG. 3 and connected via conventional hydraulic fluid conduits (not shown).

As is best seen in FIGS. 2–5, the hinged snowplow 25 includes generally equivalent length blade sections 26 and 28 extending laterally outwardly from either side of a generally vertically extending, central hinge 35 which is supported at the apex 16 of support frame 12. Each of the blade sections 26, 28 includes a mold board section *26a, 28a* (FIG. 1) curved from top to bottom such that the front snowengaging surface is concave and the rear surface is convex. At the lower edge of the mold board portions *26a, 28a*, are included hardened steel scraping blades *26b, 28b* which are bolted, welded, or otherwise secured to the mold boards for contact with the surface to be cleared of snow. Welded along the back of the mold board portions are bracing members *26c, d,* and *e* and 28*c, d,* and *e,* respectively, which run along the length and height of the blades at spaced intervals for strength.

Figure 4:
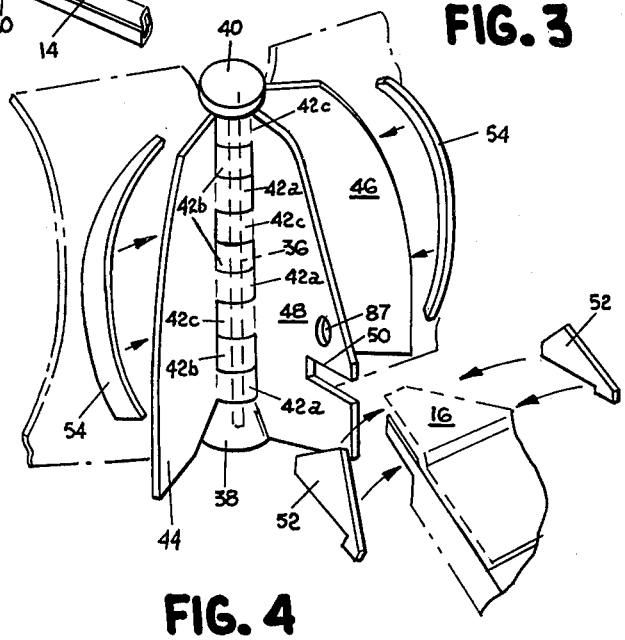
FIG. 4 is a rear, perspective, partially exploded view of the hinge structure for converting a rectilinear, rigid snowplow blade to a hinged unit.
Figure 5:
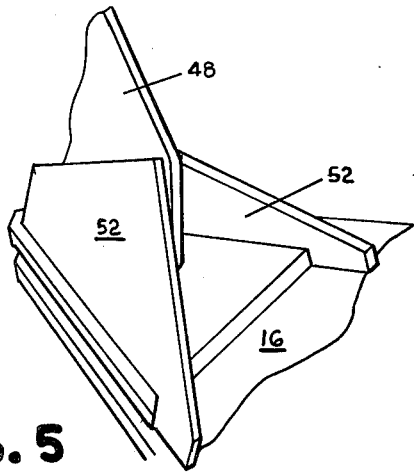
FIG. 5 is a fragmentary, perspective view of the gusset plates for bracing the hinge support plate of the present hinge structure.

Central hinge 35 includes a generally vertically extending axle 36 secured to a lower, cone-shaped foot 38 at its bottom and a top securing disc 40 welded or bolted to its top (FIG. 4). Cone-shaped foot 38 may be cast as a solid part or fabricated from sheet metal parts and welded to the lower end of axle 36. The lower inside corners of the scraping blades 26*b,* 28*b* are beveled or cut away to match the tapered contour of foot 38 (FIG. 1). Pivotally secured and stacked along hinge axle 36 are a plurality of cylindrical collars or bushings 42 which are alternately secured to blade-support plates 44, 46 or vertically extending planar hinge support plates 48. Three vertically spaced collars 42*a* are welded to the inside edge of lateral blade support plate 44. Another set of three vertically spaced collars 42*b* are welded to the inside edge of blade support plate 46. A third set of three vertically spaced collars 42*c* and foot member 38 are welded to vertically extending hinge support plate 48. Each of these collar sets and their associated support plates may thus pivot horizontally relative to one another about the vertical axis provided by hinge axle 36.

Hinge support plate 48 is secured to the apex 16 of support frame 12 via a rearwardly opening slot 50 (FIG. 4) in which apex 16 is fitted and thereafter welded or otherwise secured. Apex 16 is secured intermediate the top and bottom of hinge 35 and plate 48. Plate 48 extends generally the entire height of the hinge and tapers outwardly toward the support apex from above and below the support for bracing strength. Angling upwardly from the outer edges of apex 16 to the side surfaces of hinge support plate 48 are gusset or bracing plates 52 (FIGS. 4 and 5) which rigidly and fixedly support the hinged support plates such that it provides the sole support for the entire hinge 35 and blade sctions 26, 28. The outward projection of the generally planar hinge support plate beyond the apex 16 provides a thin hinge area allowing a greater degree of horizontal pivotal movement of blade sections 26,, 28 than was previously known such that the blade may be formed into the various positions described herein.

Figure 2:
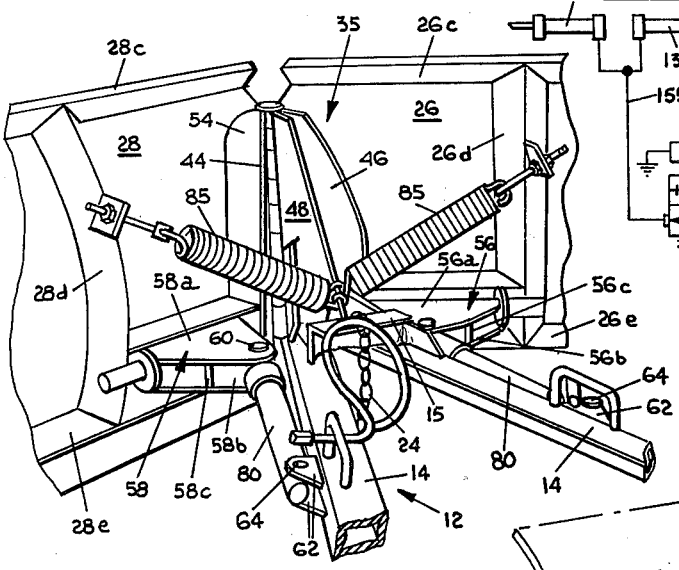
FIG. 2 is a rear, perspective view of the hinged structure of one embodiment of the hinged snowplow.
Figure 3:
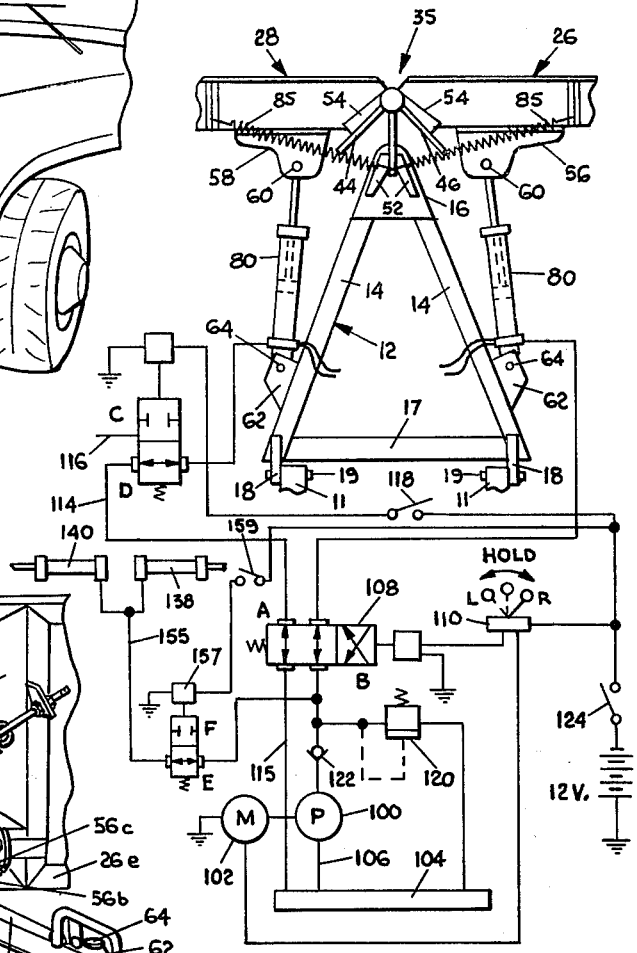
FIG. 3 is a schematic plan view of the snowplow embodiment shown in FIG. 2 with the blades positioned rectilinearly and across the front of the vehicle including a schematic diagram of one form of the hydraulic system for controlling the position of the blades.

As is shown in FIGS. 2–4, blade support plates 44, 46 are welded to the inner hinge end edges of the blade sections 26, 28 at a rearwardly extending angle (FIG. 3). Such angle facilitates movement of the blades for movement of snow to both sides of said hinge. The inner blade ends are previously cut in a curved contour to meet the planar surface of the support plates 44, 46 with a template as set forth hereinafter. When so cut, the blade end edges lie in planes abutting the planar surfaces of plates 44, 46 at an angle to the direction of elongation of the blades. Bracing members or plates 54, which are elongated and curved to match the curved convex contour of the rear surface of blade sections 26, 28, are inserted between the inner side surfaces of blade support plates 44, 46 and the rear surfaces of the blades and welded in place to securely brace the blade support members. The upper end of the brace members 54 are welded to one of the collars 42 while their lower ends are welded to conical foot 38.

Welded or otherwise fixedly secured on the rear surfaces of each of the blade sections 26, 28 are blade positioning arm securing brackets 56, 58. Brackets 56, 58 are elongated in the longitudinal dimension of the blade to provide secure support for the positioning arms and include spaced upper and lower plates 56*a,* 56*b* and 58*b* between which the positioning arms are pivotally secured via pivot pins 60. Spacing members 56*c,* 58*c* are secured between plates 56*a,* 56*b* and 58*a,* 58*b*.

Figure 6:
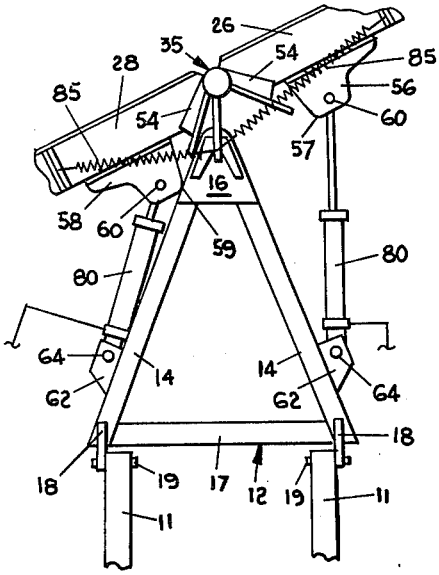
FIG. 6 is a fragmentary, schematic plan view of the snowplow structure shown in FIGS. 2 and 3 with the blades positioned rectilinearly and angled to one side.
Figure 8:
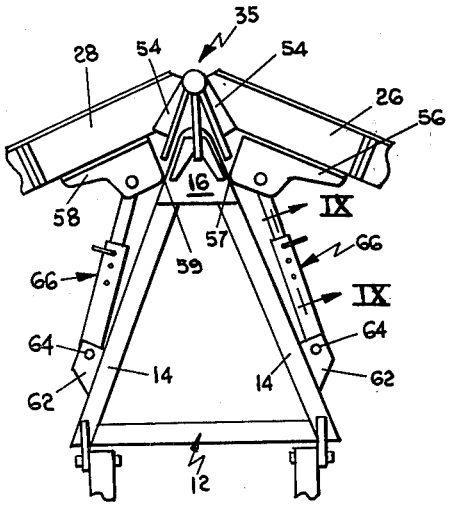
FIG. 8 is a fragmentary, schematic plan view of yet another embodiment of the hinged snowplow including manual blade positioning arms and illustrating the blades in the forwardly extending V position.

Brackets 56, 58 also provide abutments or stops for limiting the rearward pivotal movement of blade sections 26, 28 about vertical hinge 35 toward the support frame 12. Brackets 56, 58 include outwardly projecting portions on blade 56*a,* 56*b* and 58*a,* 58*b* whose inner corners 57, 59 contact and engage the side surfaces of side frame members 14 adjacent the apex 16 of frame 12 (FIGS. 6 and 8). The brackets thus limit the individual pivotal movement of the blades such that the blades may be positioned in a forwardly extending V as shown in FIG. 8 or angled to one side or the other as shown in FIG. 6.

Various embodiments of the blade positioning arms pivotally connected to brackets 56, 58 may be used depending on whether manual or powered operation is desired. Regardless of the type of positioning arm used, each arm is pivotally connected to the side frame members 14 by means of a pair of vertically spaced connecting flanges 62 extending outwardly from the side frame members 14 between which the rearward end of the positioning arm is pivotally fastened by means of pins 64. As explained below, universal connections are used in certain instances.

Figure 9:
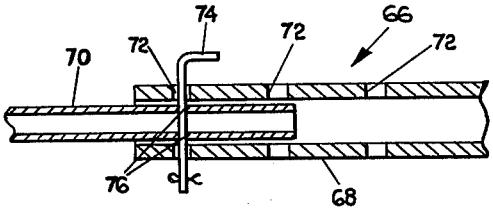
FIG. 9 is a fragmentary, sectional view of one of the manually controlled blade-positioning arms taken along plane IX—IX of FIG. VIII.

For manual operation and pivoting of the blade sections, manually extendible telescoping positioning arms 66 may be used as shown in FIGS. 8 and 9. These arms include a tubular arm member 68 within which is telescopically fitted a smaller diameter, extendible tube 70. Larger tube 68 includes a series of spaced, aligned, apertures 72. A securing pin 74 is passed through aligned apertures 76 in smaller tube 70 when apertures 72, 76 are brought in registry with one another. The spacing of apertures 72 allows the blade sections 26, 28 to be independently pivoted about hinge 35 and held in that position by insertion of pin 74.

For powered operation, either single direction acting fluid cylinders 80 (FIGS. 2, 3, and 6), or double direction acting fluid cylinders 90 (FIG. 7) may be used as part of the positioning arms. Each of the fluid cylinders 80 or 90 includes a movable piston sealed within the outer cylinder and connected to an extendible shaft or rod which is pivotally connected to brackets 56 or 58 by pin 60. When single direction acting cylinders 80 are utilized, hydraulic fluid is inserted at the rearward end of the cylinder to force the piston outwardly thus changing the position of the blade. In such case, return of the blades rearwardly is accomplished using biasing springs 85 connected by means of hooked, spring end portions to a securing bolt on the rear surfaces of blade sections 26, 28 and a securing aperture 87 formed in the rearward portion of vertically extending hinge support plate 48 (FIG. 4). The strength of springs 85 is sufficient to return the blades to their rearward position when appropriate valving is opened to allow fluid to exit from behind the movable piston. The connection of springs 85 to the blade sections is made by means of securing bolts and plates welded to portions of the blade sections intermediate the free end edges of the blade sections and the hinge 35 (FIG.2). Alternatively, the return springs 85' may be positioned between the rear of the blade sections and securing means on the side frame members 14 (FIG. 1).

Figure 7:
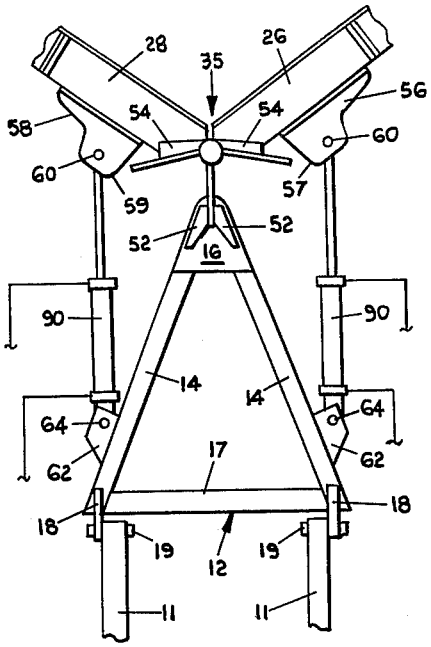
FIG. 7 is a fragmentary, schematic plan view of another embodiment of the snowplow structure with the blades positioned in the recessed, cupped, carrying position.

When double direction acting fluid cylinders 90 are used as shown in FIG. 7, biasing return springs 85 are eliminated since fluid may be directed via appropriate hydraulic lines to either end and either side of the movable piston within the cylinders 90. Cylinders 90, therefore, alternately extend or retract the movable shafts and thus the blade sections 26, 28.

With any of the embodiments of the hinged snowplow disclosed in FIGS. 1–9, the blades, because of the centrally positioned hinge, may be located in various positions to accomplish various snow removal functions. To push snow straight ahead, the blade sections may be positioned rectilinearly with one another as shown in FIG. 3 and generally transverse to the direction of motion of the vehicle. For clearing snow to one side or the other, the blades may be positioned rectilinearly with respect to one another and angled to either lateral side of the vehicle such that bracket 56 or 58 forms a limit to the rearward pivoting of the blade on the side to which the two blades are angled (FIG. 6). Should it be desired to push and clear snow straight ahead without allowing it to spill to either side of the vehicle, the blades may be positioned in a recessed, cupped, or carry position with the lateral ends of the blades extending forwardly of the position of hinge 35 to form a concave or recessed configuration (FIG. 7). For clearing paths through deep snow in the direction of motion of the vehicle, the blades may be positioned in a forwardly extending V as shown in FIG. 8 allowing snow to be moved to both sides of the vehicle simultaneously.

A schematic illustration of a preferred form of a hydraulic system for controlling the position of the blades when single direction acting fluid cylinders 80 are used is shown in FIG. 3. The system includes a pump 100 powered by an electric motor 102. Hydraulic fluid is pumped from reservoir 104 through conduit 106 to a two-position electric solenoid operated valve 108 controlled from a switch or control unit 110 mounted in the cab of the vehicle on which the snowplow unit is mounted. When the control lever of switch 110 is pushed to the right as shown in FIG. 3, fluid is directed through the left-hand A portion of the valve through conduit 112 such that the right-hand cylinder 80 is extended. At the same time, fluid is allowed to return from left-hand cylinder 80 through conduits 114 and 115 to reservoir 104 as long as electric solenoid operated valve 116 is positioned in position D as illustrated. Valve 116 is controlled by switch 118 separate and apart from switch 110 and is also mounted in the cab of the snowplow vehicle. The above-described operation positions the blade angled to the left as shown in FIG. 6.

Should it be desired to angle the blade to the opposite side of the vehicle, switch 110 is pushed to the left position actuating the solenoid of valve 108 for movement to position B. Fluid is thus directed through conduit 114 to the left-hand cylinder 80 while fluid is simultaneously withdrawn by the force of the biasing spring pressing against the movable piston in the right-hand cylinder through conduit 112 and 115 and back to the reservoir.

In order to position the blades in their concave, recessed, or cupped position as shown in FIG. 7, valve 108 is positioned in position B and switch 118 is closed to move valve 116 to position C. This prevents fluid from escaping from left-hand cylinder 80 and retains blade 28 in its forward position. Thereafter, switch 110 is moved to its right position, positioning valve 108 in position A and directing fluid to right-hand cylinder 80. Blade 26 thus moves to its forward position with the configuration shown in FIG. 7 resulting.

In order to position the blades in their forwardly extending V position as shown in FIG. 8, switch 110 is moved to its right position moving valve 108 to position A such that blade 26 is moved forwardly and blade 28 rearwardly. Thereafter, switch 118 is thrown to position valve 116 in position C to prevent insertion of fluid in the left-hand cylinder 80 thereby holding blade 28 in its rearward position and switch 110 is moved to its left position. Valve 108 moves to its position B allowing withdrawal of fluid from the right-hand cylinder 80 and moving blade 26 to its rearward position as shown in FIG. 8.

Also included in the hydraulic system are a pressure release valve 120 allowing the pump to return fluid to the reservoir 104 should either cylinder be at the end of its extension or valve 116 be in its C position all of which prevent fluid flow through the respective conduits. A check valve 122 prevents undesired return of fluid through pump 100 while a main ignition switch 124 controls operation of the entire circuitry and the solenoid-operated valves from the vehicle battery. The remaining portion of the hydraulic schematic diagram which controls the blade extension cylinders illustrated in FIGS. 12–15 will be explained below in connection with those figures.

CONVERSION KIT AND METHOD THEREFOR

Figure 11:
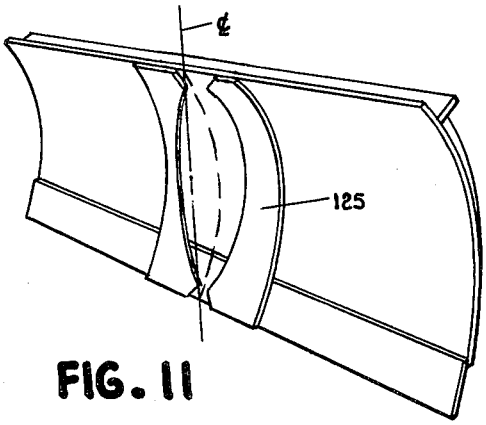
FIG. 11 is a front perspective view of a typical, rigid, rectilinear snowplow blade showing the template of FIG. 10 positioned on either side of the blade centerline for marking the same prior to cutting.
Figure 10:
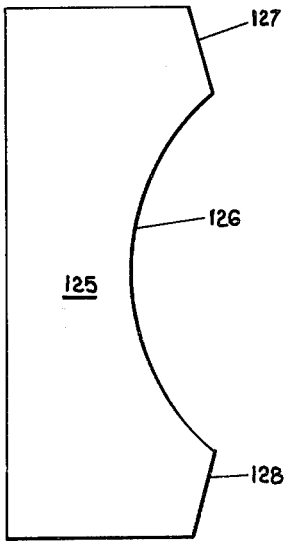
FIG. 10 is a front elevation of a template for marking an existing rigid, rectilinear snowplow blade for cutting to convert the blade to a hinged blade as disclosed in the present invention.

The present invention also encompasses apparatus and method for converting a pre-existing rigid, rectilinear plow blade such as is shown in FIG. 11 to a hinged unit as described above in connection with FIGS. 1–9. The conversion kit is adapted for use with pre-existing vehicular snowplows having support frames 12, means for raising and lowering the support frame and attached plow blades 21–24, and a rectilinear, rigid plow blade pivotally secured in some fashion to the end of the support frame 12. Once the existing plow blade is removed from the pre-existing support frame, the conversion kit and method are used to prepare and assemble the plow portions to form the hinged snowplow as described in connection with FIGS. 1–9.

The conversion kit includes a plow blade template or pattern 125 (FIG. 10) having a curved, arcuate edge 126 for marking the front surface of an existing rectilinear blade. Such blades typically include a curved cross section which must be marked along curved lines in preparation for cutting to fit the planar surfaces of blade support plates 44, 46. Also included are edges 127, 128 for marking the upper and lower portions of the severed blade portions to match the tapered contour of the conical foot 38 and to provide clearance for pivoting the blades to their recessed or cupped position as shown in FIG. 7.

Also included in the conversion kit is the central hinge structure 35 typically provided as a unit including axle 36, foot 38, and top plate 40, cylinders or bushings 42, and blade support and hinge support plates 44, 46, 48, welded to the cylinders 42 as described in connection with FIG. 4. Also included are gusset or brace plates 52, brace members 54, brackets 56 and 58, as well as biasing return springs 85 and their associated attaching hardware should the existing plow include single direction acting fluid cylinders such as are shown at 80. The conversion kit also includes an electric solenoid-operated two-position valve 116, switch 118, and associated wiring and fluid connections for insertion in a hydraulic system similar to that shown in FIG. 3. The valve is inserted in the fluid conduit leading to either one of the cylinders 80 and switch 118 is mounted in the cab of the vehicle. Alternately, if the plow is to be operated manually, the kit may include telescoping positioning arms 66 in place of return spring 85.

To complete the conversion, templates 125 are first placed on either side of the center line of the existing rectilinear blade as shown in FIG. 11, and the blade is marked along the curved template or pattern edges. Thereafter, the blade is severed along the marked line in the curved contour and hinge assembly 35 is positioned between the inner edges of the blade. Blade support plates 44, 46 are welded at an angle to the end edges of the blade sections. Braces 54 are inserted between the rear surfaces of blade sections 26, 28 and the inner surfaces of blade support plates 44, 46 and welded in place (FIGS. 2 and 4).

Once the hinge assembly 35 and blade sections 26, 28 are secured together as above, the same may be secured to the apex 16 of support frame 12 by fitting the apex in slot 50 and welding the plate on both sides of the apex. Gusset or brace plates 52 are welded at an angle extending upwardly from the edges of apex 16 to the side surface of support plate 48. Thereafter, the positioning arms are connected by pivot pins 60 to brackets 56, 58 which have been welded in place generally at the level of the slot 50 on the respective rear surfaces of blade sections 26, 28 and the blade return springs 85 are mounted between the blade sections and aperture 87 of the support plate 48.

BLADE EXTENSION APPARATUS

Figure 12:
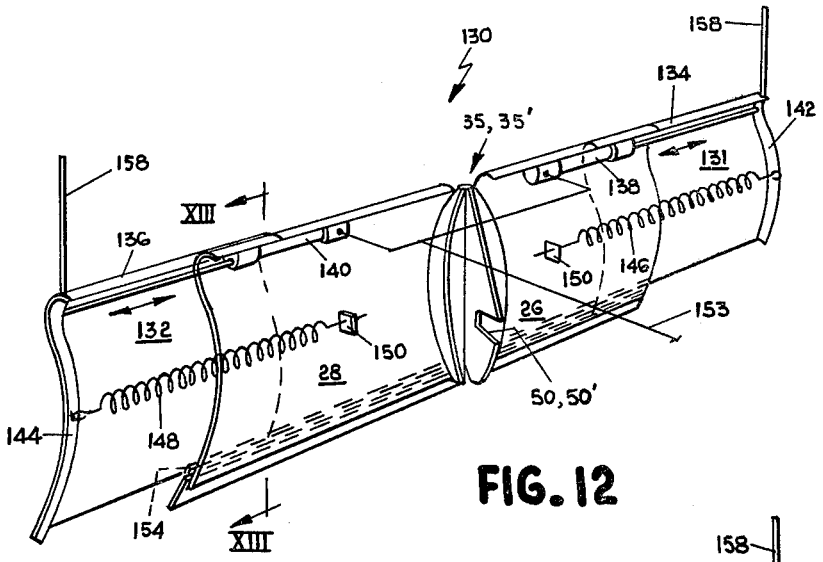
FIG. 12 is a rear, perspective view of one embodiment of the snowplow blade extension apparatus of the present invention.

Referring now to FIGS. 12–16, various embodiments of extension apparatus for use with the above-described hinged snowplow blade sections as well as other types of plow blades, whether hinged or not, are illustrated. As shown in FIG. 12, a first embodiment 130 of the extension apparatus basically includes secondary or supplemental plow mold boards or blades 131 and 132 which are formed to have the same contour as the basic plow blades 26, 28. Blades 131, 132 are somewhat shorter than the overall height of basic blades 26, 28, and include flanges 134, 136 extending along their top edges for fitting over the top edges of the basic plow blades. The flanges 134, 136 support the secondary blades and allow blades 131, 132 to slide longitudinally along blade sections 126, 128 as moved by single direction acting fluid cylinders 138, 140.

Cylinders 138, 140 are secured immediately adjacent the upper edge of basic blades 131, 132, protected by any upper flange on blades 26, 28, and connected via extendible shafts to end plates 142, 144 on the respective blades. Biasing return springs 146, 148 are connected between end plates 142, 144 and attachment plates 150 secured to the rear surfaces of basic plow blades 26, 28. Accordingly, when hydraulic fluid is directed through conduit 155 to the inner ends of cylinders 138, 140, the pistons contained therein extend the shafts and slide secondary blades 131, 132 outwardly to provide additional length for the plow blades. Through appropriate valving, the return springs 146, 148 return the blades to their original positions when fluid is allowed to exit from cylinders 138, 140.

Figure 13:
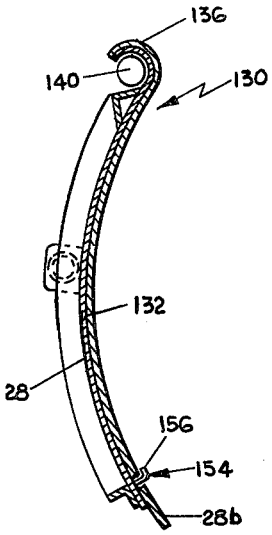
FIG. 13 is a side sectional view of the blade extension apparatus taken along plane XIII—XIII of FIG. 12.

In order to retain secondary blades 131, 132 against the front surface of the basic blades, an elongated guide channel 154 having an upwardly directed flange 156 overlaps the lower edge of each of the secondary blades as shown in FIG. 13. Such channel both guides the longitudinal extension of the secondary blades and prevents the blades from moving outwardly away from the front surface of the basic blades. Also included are upwardly extending antenna or end markers 158 at the outer, upper edge of each of the secondary blades 131, 132 such that the end of the blade can be immediately located by the driver of the vehicle operating the snowplow.

As shown in FIG. 3, the preferred embodiment of the hydraulic system for controlling the single acting cylinders 138, 140 of embodiment 130 includes a hydraulic conduit 155 leading to the inside ends of both cylinders 138, 140 and controlled by electric solenoid-operated, two-position valve 157. Valve 157 is controlled by a switch 159 mounted in the cab of the snowplow vehicle. When pump 100 is operated and valve 157 is in position E, secondary blades 131, 132 may be extended as desired via the cylinders. When valve 157 is positioned at F, the cylinders are held in their respective positions regardless of the operation of pump 100.

Figure 15:
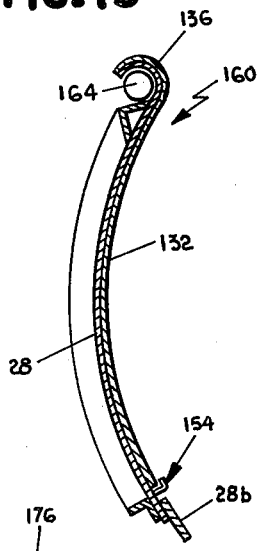
FIG. 15 is a side sectional view of the blade extension apparatus taken along plane XV—XV of FIG. 14.
Figure 14:
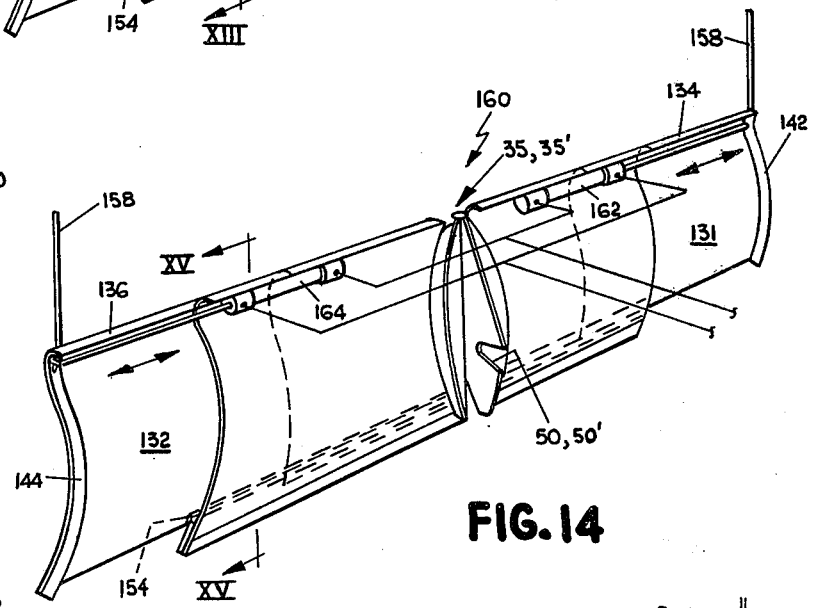
FIG. 14 is a rear perspective view of a second embodiment of the blade extension apparatus.

Embodiments 160 of the blade extension apparatus shown in FIGS. 14 and 15 is similar in all respects to embodiment 130 except for the elimination of biased return springs 146, 148 and the inclusion of double acting fluid cylinders 162, 164 in place of single acting cylinders 138, 140. In embodiment 160, appropriate valving and hydraulic fluid conduits lead to both ends of the cylinders 162, 164.

Figure 17:
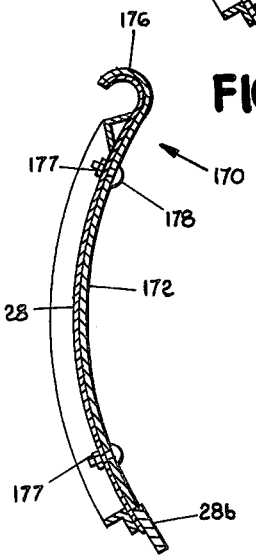
FIG. 17 is a side sectional view of the blade extension embodiment taken along plane XVII—XVII of FIG. 16.
Figure 16:
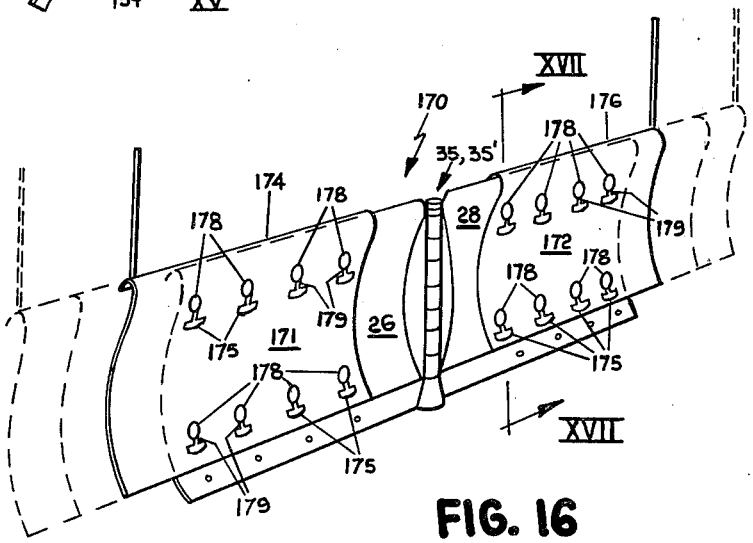
FIG. 16 is a front perspective view of a third embodiment of the blade extension apparatus.
Figure 18:
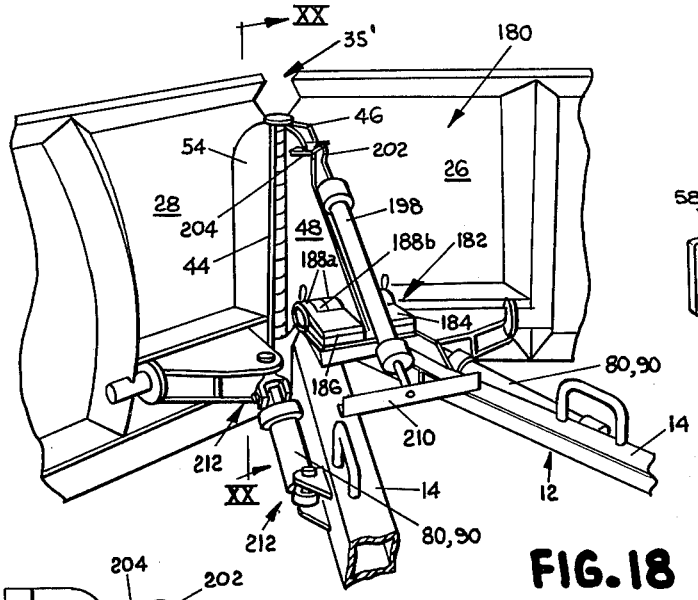
FIG. 18 is a rear perspective view of yet another embodiment of the hinged snowplow apparatus including a horizontal hinge allowing pivotal movement of the hinge and plow structure to avoid obstacles encountered during plowing.

As shown in FIGS. 16 and 17, a manually operable embodiment 170 of the blade extension apparatus includes secondary or supplemental blades 171, 172 again contoured to fit the front surface contour of the basic blades 26, 28. Like blades 131, 132, blades 171, 172 include top edge flanges 174, 176 which support the secondary blades on the basic blades. Instead of fluid cylinders for slidingly extending the blades on the basic blades as guided by guide channels 154, manual embodiment 179 includes a plurality of spaced bolts 177 near the upper and lower edges of the basic blades, extending outwardly therefrom, and having enlarged heads 178 spaced from the front surface of the basic blades. Located correspondingly in the secondary blades 171, 172 are a like number of apertures having openings 175 large enough to receive the enlarged heads 178 therethrough and upwardly extending slots 179 having a width less than the greatest width of the enlarged head 178. Accordingly, the secondary blades 171, 172 may be positioned as desired with the enlarged heads being received through openings 175 and the shafts of bolts 177 extending into the reduced widths of upwardly extending slots 179 such that the enlarged heads retain the blades as positioned. Although embodiment 170 is shown as including eight bolts for each secondary blade such that four bolts will retain the blade in its outwardmost extended position, a number of bolts may be determined as required for the sufficient strength of the extended blades.

BLADE YIELDING APPARATUS

Referring now to FIGS. 18–23, apparatus for allowing the centrally hinged plow blade to pivot as a unit about a horizontal axis to avoid damage due to obstacles struck during plowing is illustrated. As shown in the first embodiment 180 in FIGS. 18–20, a generally horizontally disposed hinge unit 182 is secured in slot 50 of vertical hinge support plate 48 at the rear of vertical hinge unit 35' between blade sections 26, 28. The upper edge of V-shaped slot 50' is welded or otherwise secured to an upper hinge plate 184 in unit 182 while a lower hinge plate 186, which is somewhat longer than upper plate 184, is welded or otherwise secured atop apex 16 of support frame 12. The outer edge of upper plate 184 is welded to the exterior of a series of cylindrical collars 188*a* which are spaced along a horizontal hinge pin or axle 190. Lower hinge plate 186 is welded to collars 188*b* which alternate with collars 188*a* along the length of the hinge pin. Cotter keys or pins 192 project through collars 188*a* at either end of the hinge unit to hold the hinge pin in place.

Figure 20:
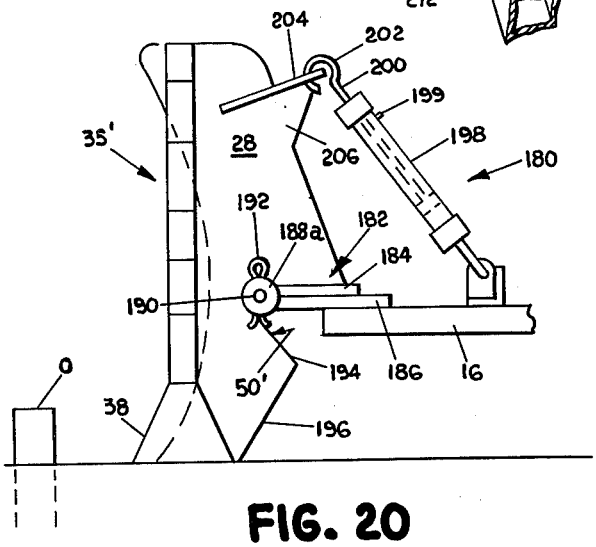
FIG. 20 is a side elevation of the hinged structure shown in FIG. 18 in its generally vertically upright position and illustrating a pneumatic cylinder for biasing the structure to that position.
Figure 21:
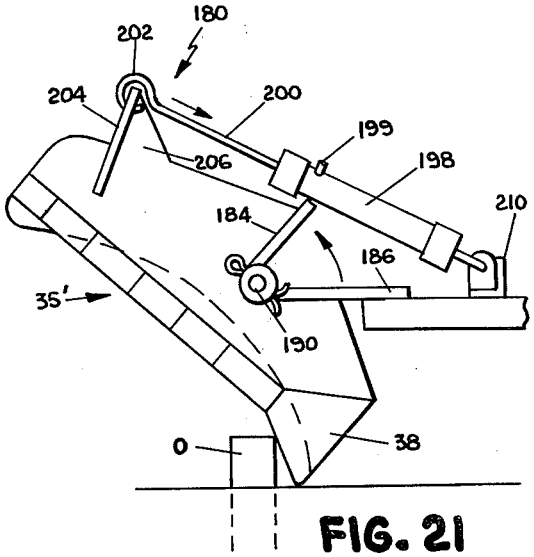
FIG. 21 is a side elevation of the hinged embodiment shown in FIG. 20 but illustrated in its tipped or pivoted position.

In order to allow pivotal movement about the horizontal hinge should an obstacle O be struck by the blade during plowing as shown in FIGS. 20 and 21, the lower portions of the hinge support plate 48 are cut away at edges 194, 196. Edge 194 forms the lower edge of V-shaped slot 50'. These edges provide clearance for upward pivotal movement about hinge pin 190 for the lower portion of the hinge assembly 35. For return of the vertical hinge and blade unit to its generally vertically upright position as shown in FIG. 20, from its pivoted or tipped position shown in FIG. 21, a pneumatic biasing cylinder 198 is provided including extendible shaft 200 having a hook 202 at its end. Hook 202 is attached to securing plate 204 welded to the upper portion of support plate 48 which has a support flange 206 for additional support of the securing plate. The opposite end of the biasing cylinder 198 is pivotally secured via hook 208 to an aperture in a channel member or bracket 210 secured between side frame members 14 immediately rearwardly of apex 16. Pneumatic cylinder 198 is the type including a movable piston and a compressible fluid such as air inserted via valve 199 such that when an obstacle forces the pivotal movement of hinge 35 and blades 26, 28 about pin 190, the fluid is compressed, and the blade assembly yields to the obstacle. When the obstacle is passed, the compressible fluid moves the movable piston within the sealed cylinder 198, and thus shaft 200, to return the blade assembly to its vertically upright position as shown in FIG. 20. The air pressure within cylinder 198 may be increased or decreased with valve 199 to make a "harder" or "softer" yielding plow.

Figure 19:
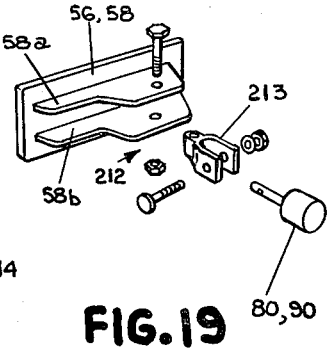
FIG. 19 is a fragmentary, perspective view of a U joint connection between one of the blade positioning arms and a bracket on the rear of one of the blade sections.

As shown in FIG. 19, in order to allow the pivotal movement about horizontal axis 190 of the blade assembly, the positioning arms including cylinders 80 or 90, or the manually positioned arms 66, include universal joint connections 212 at either end thereof, namely, at brackets 56, 58, and at securing flanges 62 at side frame members 14. The universal joints include generally U-shaped brackets 213 secured by a generally vertical bolt between plates 58*a*, 58*b*, with the arm or securing flange extending from one end of the cylinder 80, 90 extending between the side flanges of bracket 213 and pinned by a horizontal bolt. These joints allow universal pivotal movement for each end of the positioning arms.

Figure 22:
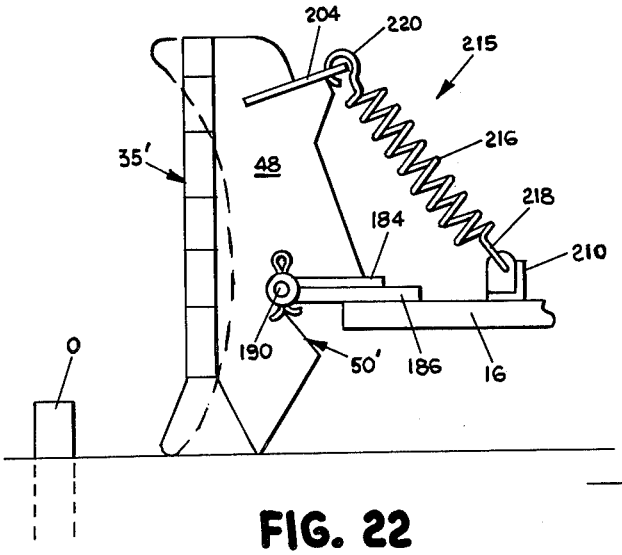
FIG. 22 is a side elevation of a second embodiment of the horizontally hinged snowplow including a coil spring biasing means.

In an alternative embodiment 215 of the horizontally hinged, yieldable blade assembly, a coil spring 216 having hooked end portions 218 and 220 may be secured between plate 204 and securing channel 210 as shown in embodiment 215 of the assembly in FIG. 22.

Figure 23:
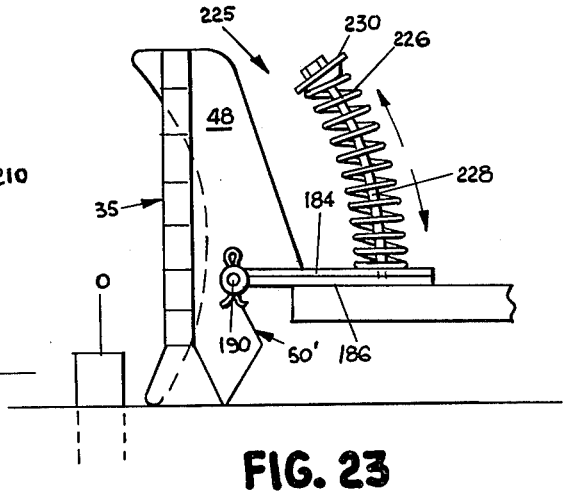
FIG. 23 is a side elevation of a third embodiment of the horizontally hinged snowplow including a second type of coil spring biasing means.

In embodiment 225 shown in FIG. 23, an alternate embodiment of a coil spring 226 is secured coaxially around a rod or shaft 228. Shaft 228 is curved and secured such that it extends upwardly and toward the hinge assembly 35 from plate 186 and is positioned concentrically with hinge coil spring 226. Coil spring 226 is held over shaft 228 by a stop or engaging member 230 which is bolted or otherwise secured to the free end of shaft 228. The lower end of coil spring 226 bears against the upper hinge plate 184 to constantly bias that plate, and thus the entire hinge and blade assembly, toward its vertically upright position to return the same should it be tipped or pivoted by engagement with an obstacle. Stop or engaging member 230 may be tightened or loosened against spring 226 with its securing bolt to increase or decrease the tension on spring 226. This results in greater or lesser resistance to tipping of the blade when obstacles are encountered and facilitates adjustment for the terrain or surfaces over which the plow will be used. In embodiment 225, the securing plate 204 at the upper end of hinge support plate 48, as well as the securing channel 210, may be eliminated.

Both the blade extension apparatus as shown in FIGS. 12–17 as well as the horizontal hinge apparatus for allowing the blade assembly to yield when obstacles are struck during plowing may be sold as part of the conversion kit described above. If the same are included, the assembly method includes positioning the fluid cylinders on the rear surfaces of the basic plow blades near the upper edges thereof. Thereafter, the secondary or supplemental plow blades are fitted over the top edges of the basic plow blades and guide channels 154 are secured along the lower edge of the basic plow blades on the front surfaces thereof. The extendible shafts of the cylinders are secured to the end plates of the secondary blades with the necessary fluid connections being made to the hydraulic system of the existing plow. Alternately, the basic blades may be drilled and fitted with the securing bolts 177 in locations corresponding to the securing apertures 180 with the blades thereafter being fitted in place.

If the horizontal hinge structure 180 is included with the conversion kit, the hinge is merely welded in place in slot 50 and secured to the outwardly extending apex 16 of the support frame. Thereafter, the necessary connections for the biasing means provided with the kit, namely, cylinder 198, spring 216, or coil spring 226 are made.

Thus, either or both of the blade extension apparatus and/or the horizontal hinge structure may be included and used with the basic plow structure or kit and method for making the basic plow structure shown in FIGS. 1–10.

While several forms of the invention have been shown and described, other forms will now be apparent to those skilled in the art. Therefore, it will be understood that the embodiments shown in the drawings and described above are merely for illustrative purposes and are not intended to limit the scope of the invention which is defined by the claims which follow.

The embodiments of the invention in which an exclusive property or privilege is claimed are defined as follows:

1. A hinged snowplow for vehicles comprising a support frame having an outwardly extending projection; means for securing said support frame to a vehicle; a pair of generally elongated plow blades; a central hinge having a generally vertical axis; means for securing said plow blades to said hinge one on either lateral side thereof for pivotal movement about said generally vertical axis independent of one another; said hinge including a single, generally vertical, hinge support member extending toward and secured to said outwardly extending projection of said support frame generally intermediate the top and bottom of said hinge, and forming a central support for said hinge and blades, said hinge support member tapering toward said outwardly extending projection from above and below said projection and extending over, beyond, and inwardly of the outermost end of said projection for stability and support strength; a pair of blade positioning arm means for positioning said blades and holding said blades as positioned, each of said arm means extending between said support frame and one of said plow blades; means for pivotally securing each of said arm means to both its respective plow blade and said support frame; said blades being movable between positions forming a forwardly extending V with said central hinge forwardmost to a forwardly open V position having the lateral plow blade edges extending forwardly of said central hinge as well as positions therebetween.

2. The hinged snowplow of claim 1 wherein said means for pivotally securing said blade positioning arm means to said plow blades include contact means for engaging said support frame to limit the pivotal movement of said blades toward the vehicle.

3. The hinged snowplow of claim 2 wherein said positioning arm means are extendible and each include at least a pair of rigid telescoping members and means for securing said telescoping members at different positions with respect to one another depending on the positions of said respective plow blades.

4. The hinged snowplow of claim 2 wherein said positioning arm means each include a single direction acting fluid cylinder for pivoting said respective blades about said hinge axis in one direction; biasing means for biasing each of said blades in the opposite direction.

5. The hinged snowplow of claim 4 wherein said biasing means include a pair of springs, each spring extending from said central hinge support member to a position on its respective blade intermediate the location at which said arm means is pivotally attached to said plow blade and the outer end of said blade.

6. The hinged snowplow of claim 2 wherein said positioning arm means each include a double acting fluid cylinder for pivoting said respective blades about said hinge axis toward and away from said vehicle.

7. The hinged snowplow of claim 2 wherein said support frame is generally triangular with a pair of side frame members extending to a central apex which forms said outwardly extending projection; said positioning arm means each extending from one of said side frame members to a bracket secured to the rear surface of said respective plow blade.

8. The hinged snowplow of claim 1 wherein said positioning arm means each include a single direction acting fluid cylinder for pivoting said respective blades about said hinge axis away from said vehicle; biasing means for biasing each of said blades toward said vehicle; hydraulic means for providing fluid power to said cylinders to extend pistons in said cylinders including a hydraulic pump, fluid conduit means for directing hydraulic fluid to and from said cylinders, first valve means for controlling hydraulic fluid flow through said conduit means to both of said cylinders, said first valve means having at least two positions including a first position in which fluid is directed to one of said cylinders while fluid is allowed to flow from the other cylinder, and a second position in which fluid is directed to the other of said cylinders while fluid is allowed to flow from said one cylinder; second valve means in the fluid conduit means extending to one of said cylinders having two positions including a first position allowing fluid flow to said one cylinder and a second position preventing fluid flow to or from said cylinder; and means for controlling said hydraulic pump and the positions of said first and second valve means.

9. The hinged snowplow of claim 8 wherein said first and second valve means are each electric solenoid controlled and each include electrical switch means electrically connected thereto for controlling activation of said respective valve means.

10. The hinged snowplow of claim 1 wherein said means for securing said support frame to a vehicle include means for pivotally securing said frame to a vehicle about a generally horizontal axis and means for attaching apparatus for raising and lowering said support frame about said axis.

11. The hinged snowplow of claim 1 including plow blade extension means for increasing the length of said plow blades including a second pair of plow blades, means for securing each of said second blades in overlying relationship to one of said first plow blades; each of said second plow blades having a contour matching that of the front surface of one of said first plow blades and adapted to be positioned such that a portion extends beyond the free end edge of one of said first plow blades; means adjacent the upper and lower edges of said blades for restraining movement of said second blades outwardly away from said first blades.

12. The hinged snowplow of claim 11 wherein said means for securing said second plow blades to said first plow blades include means for slidably mounting said second blades on said first blades and motive power means for sliding each of said second plow blades outwardly of the free end of one of said first plow blades and away from said hinge.

13. A hinged snowplow for vehicles comprising a support frame having an outwardly extending projection; means for securing said support frame to a vehicle; a pair of generally elongated plow blades; a central hinge having a generally vertical axis; means for securing said plow blades to said hinge one on either lateral side thereof for pivotal movement about said generally vertical axis independent of one another; said hinge including a single, generally vertical, hinge support member extending toward and secured to said outwardly extending projection of said support frame generally intermediate the top and bottom of said hinge, and forming a central support for said hinge and blades, said hinge support member tapering toward said outwardly extending projection from above and below said projection; a pair of blade positioning arm means for positioning said blades and holding said blades as positioned, each of said arm means extending between said support frame and one of said plow blades; means for pivotally securing each of said arm means to both its respective plow blade and said support frame; said blades being movable between positions forming a forwardly extending V with said central hinge forwardmost to a forwardly open V position having the lateral plow blade edges extending forwardly of said central hinge as well as positions therebetween; said hinge support member extending generally the entire vertical height of said hinge and including a rearwardly opening slot receiving said support frame projection; fixed brace means extending between said projection and either side of said hinge support member for holding said member in a fixed vertical position.

14. A hinged snowplow for vehicles comprising a support frame having an outwardly extending projection; means for securing said support frame to a vehicle; a pair of generally elongated plow blades; a central hinge having a generally vertical axis; means for securing said plow blades to said hinge one on either lateral side thereof for pivotal movement about said generally vertical axis independent of one another; said hinge including a single, generally vertical, hinge support member extending toward and secured to said outwardly extending projection of said support frame generally intermediate the top and bottom of said hinge, and forming a central support for said hinge and blades, said hinge support member tapering toward said outwardly extending projection from above and below said projection; a pair of blade positioning arm means for positioning said blades and holding said blades as positioned, each of said arm means extending between said support frame and one of said plow blades; means for pivotally securing each of said arm means to both its respective plow blade and said support frame; said blades being movable between positions forming a forwardly extending V with said central hinge forwardmost to a forwardly open V position having the lateral plow blade edges extending forwardly of said central hinge as well as positions therebetween; said means for securing said plow blades to said hinge including a blade support plate for each of said blades, said blade support plates extending laterally to either side of said hinge, pivotally secured to said hinge, and rigidly secured to the inner hinge ends of said blades; and a brace member rigidly secured between each of said support plates and the rear surface of the respective plow blade.

15. The hinged snowplow of claim 14 wherein said plow blades have arcuate cross sections with the front surfaces thereof being concave; said hinge ends of said arcuate blades being cut in a curvature such that those blade end edges lie in planes each abutting the side of one of said support plates; said brace members also having curved cross sections to match the convex rear surfaces of said blades.

16. The hinged snowplow of claim 14 including a cone-shaped foot at the bottom of said hinge; the bottom of the hinge ends of said plow blades being cut at an angle to match the shape of said foot.

17. The hinged snowplow of claim 16 wherein said hinge includes a central axle having a plurality of collars rotatably mounted thereon between said cone-shaped foot secured at the bottom of said axle and a top securing plate secured at the top of said axle; said hinge support member being rigidly secured to said foot and the exterior of a first set of said collars; one of said blade support plates being secured to a second set of said collars; the other blade support plate being secured to a third set of said collars; each of said collar sets including at least two collars spaced apart along said axle and alternating with the collars from said other two sets whereby said blades are individually pivotable about said axle.

18. A hinged snowplow for vehicles comprising a support frame having an outwardly extending projection; means for securing said support frame to a vehicle; a pair of generally elongated plow blades; a central hinge having a generally vertical axis; means for securing said plow blades to said hinge one on either lateral side thereof for pivotal movement about said generally vertical axis independent of one another; said hinge including a single, generally vertical, hinge support member extending toward and secured to said outwardly extending projection of said support frame generally intermediate the top and bottom of said hinge, and forming a central support for said hinge and blades, said hinge support member tapering toward said outwardly extending projection from above and below said projection; a pair of blade positioning arm means for positioning said blades and holding said blades as positioned, each of said arm means extending between said support frame and one of said plow blades; means for pivotally securing each of said arm means to both its respective plow blade and said support frame; said blades being movable between positions forming a forwardly extending V with said central hinge forwardmost to a forwardly open V position having the lateral plow blade edges extending forwardly of said central hinge as well as positions therebetween; plow blade extension means for increasing the length of said plow blades including a second pair of plow blades, means for securing each of said second blades in overlying relationship to one of said first plow blades; each of said second plow blades having a contour matching that of the front surface of one of said first plow blades and adapted to be positioned such that a portion extends beyond the free end edge of one of said first plow blades; said means for securing said second plow blades to said first plow blades including a flange extending along the length of the top edge of each of said second plow blades, said flanges supporting said second plow blades on the top edges of said first plow blades.

19. The hinged snowplow of claim 18 including a plurality of projections on the front surfaces of said first plow blades, each projection having an enlarged head spaced from the front surface of the first plow blade; said second plow blades each including a plurality of apertures therethrough in locations corresponding to the positions of said headed projections on said first plow blades, each of said apertures having an enlarged area slightly larger than the size of said projection heads and a slot area extending upwardly from said enlarged area and having a width less than that of said projection heads, each of said projections being received through one of said enlarged aperture areas and into a slot area for retention of said second blades on said first blades, said heads on said projections preventing outward movement of said second blades away from said first blades.

20. A hinged snowplow for vehicles comprising a support frame having an outwardly extending projection; means for securing said support frame to a vehicle; a pair of generally elongated plow blades; a central hinge having a generally vertical axis; means for securing said plow blades to said hinge one on either lateral side thereof for pivotal movement about said generally vertical axis independent of one another; said hinge including a single, generally vertical, hinge support member extending toward and secured to said outwardly extending projection of said support frame generally intermediate the top and bottom of said hinge, and forming a central support for said hinge and blades, said hinge support member tapering toward said outwardly extending projection from above and below said projection; a pair of blade positioning arm means for positioning said blades and holding said blades as positioned, each of said arm means extending between said support frame and one of said plow blades; means for pivotally securing each of said arm means to both its respective plow blade and said support frame; said blades being movable between positions forming a forwardly extending V with said central hinge forwardmost to a forwardly open V position having the lateral plow blade edges extending forwardly of said central hinge as well as positions therebetween; plow blade extension means for increasing the length of said plow blades including a second pair of plow blades, means for securing each of said second blades in overlying relationship to one of said first plow blades; each of said second plow blades having a contour matching that of the front surface of one of said first plow blades and adapted to be positioned such that a portion extends beyond the free end edge of one of said first plow blades; said means for securing said second plow blades to said first plow blades including means for slidably mounting said second blades on said first blades and motive power means for sliding each of said second plow blades outwardly of the free end of one of said first plow blades and away from said hinge; said means for slidably mounting said second blades on said first blades including a flange extending along the top of each of said second plow blades for slidingly supporting said second blades along the top edges of said first plow blades; guide means on the front surface of said first plow blades for guiding the sliding movement of said second plow blades along said first blades and for limiting outward movement of said second plow blades away from said first blades; and an end flange on each of said second plow blades forming a stop limiting inward movement of said second plow blades toward said hinge.

21. The hinged snowplow of claim 20 wherein said motive power means include a single direction acting fluid cylinder mounted on the rear surface of each of said first plow blades adjacent the top edge thereof, each of said cylinders having a piston for moving an extendible shaft, said extendible shaft being connected to said end flange of said second plow blade, and means for directing fluid to and from one side of said piston within said cylinders; biasing means for biasing each of said second plow blades inwardly toward said hinge.

22. The hinged snowplow of claim 20 wherein said motive power means include a double direction acting fluid cylinder mounted on the rear surface of each of said first plow blades adjacent the top edge thereof, each of said cylinders having a piston for moving an extendible shaft, said extendible shaft being connected to said end flange of said second plow blade, and means for directing fluid to and from each side of said piston in said cylinders.

23. A hinged snowplow for vehicles comprising a support frame having an outwardly extending projection; means for securing said support frame to a vehicle; a pair of generally elongated plow blades; a central hinge having a generally vertical axis; means for securing said plow blades to said hinge one on either lateral side thereof for pivotal movement about said generally vertical axis independent of one another; said hinge including a single, generally vertical, hinge support member extending toward and secured to said outwardly extending projection of said support frame generally intermediate the top and bottom of said hinge, and forming a central support for said hinge and blades, said hinge support member tapering toward said outwardly extending projection from above and below said projection; a pair of blade positioning arm means for positioning said blades and holding said blades as positioned, each of said arm means extending between said support frame and one of said plow blades; means for pivotally securing each of said arm means to both its respective plow blade and said support frame; said blades being movable between positions forming a forwardly extending V with said central hinge forwardmost to a forwardly open V position having the lateral plow blade edges extending forwardly of said central hinge as well as positions therebetween; plow blade extension means for increasing the length of said plow blades including a second pair of plow blades, means for securing each of said second blades in overlying relationship to one of said first plow blades; each of said second plow blades having a contour matching that of the front surface of one of said first plow blades and adapted to be positioned such that a portion extends beyond the free end edge of one of said first plow blades; a generally horizontal hinge means secured in a rearwardly opening slot in said hinge support member for pivotal movement of said central hinge and plow blades about a generally horizontal axis with respect to said support frame, and biasing means for biasing said central hinge and plow blades toward a generally vertically upright position whereby said central hinge and plow blades can pivot up and over obstacles encountered during plowing.

24. A hinged snowplow for vehicles comprising a support frame having an outwardly extending projection; means for securing said support frame to a vehicle; a pair of generally elongated plow blades; a central hinge having a generally vertical axis; means for securing said plow blades to said hinge one on either lateral side thereof for pivotal movement about said generally vertical axis independent of one another; a pair of blade positioning arm means for positioning said blades and holding said blades as positioned, each of said arm means extending between said support frame and one of said plow blades; rigid contact means extending outwardly from the rear of each of said plow blades for contacting said support frame to limit pivotal movement of said respective blades toward the vehicle, said contact means including means for pivotally securing one end of each of said arm means to its respective plow blade; said support frame including means for pivotally securing the other ends of said arm means to said support frame; said rigid contact means including rigid portions extending rearwardly and inwardly of the positions at which said one ends of said arm means are pivotally secured to said respective plow blades from said rear of each plow blade; said blades being movable between positions forming a forwardly extending V with said central hinge forwardmost to a forwardly open V position having the lateral plow blade edges extending forwardly of said central hinge as well as positions therebetween.

25. The hinged snowplow of claim 24 wherein said contact means include a bracket on the rear of each of said plow blades having a pair of spaced, rigid plates which project outwardly therefrom, the edge of at least one of said bracket plates adapted to contact said support frame with the ends of said positioning arm means pivotally secured therebetween.

26. A hinged snowplow for vehicles comprising a support frame having an outwardly extending projection; means for securing said support frame to a vehicle; a pair of generally elongated plow blades; a central hinge having a generally vertical axis; means for securing said plow blades to said hinge one on either lateral side thereof for pivotal movement about said generally vertical axis independent of one another; said hinge including a generally vertical, hinge support member extending rearwardly therefrom and forming a central support for said hinge and blades; a pair of blade positioning arm means for positioning said blades and holding said blades as positioned, each of said arm means extending between said support frame and one of said plow blades; means for pivotally securing each of said arm means to both its respective plow blade and said support frame; said blades being movable between positions forming a forwardly extending V with said central hinge forwardmost to a forwardly open V position having the lateral plow blade edges extending forwardly of said central hinge as well as positions therebetween; central horizontal hinge means secured between said central hinge support member and said outwardly extending projection for pivotal movement of said central hinge and plow blades about a generally horizontal axis with respect to said support frame, said central hinge support member extending inwardly of said projection to an end position for support and stability, said central horizontal hinge means having a horizontal pivot axis positioned intermediate said end position of said support member and said vertical axis of said central hinge; and biasing means for biasing said central hinge and plow blades toward a generally vertically upright position yet allowing said central hinge and plow blades to pivot up and over obstacles encountered during plowing.

27. The hinged snowplow of claim 26 wherein said means for pivotally securing said blade positioning arm means include a universal joint extending between one end of each arm means and said support frame and between the other end of each arm means and said respective plow blades whereby said blade positioning arm means can pivot upwardly when said central hinge and plow blades pivot about said generally horizontal axis or laterally when the positions of said plow blades about said generally vertical axis are changed.

28. The hinged snowplow of claim 26 including means for adjusting the strength or resistance to pivotal movement of said biasing means to facilitate use of said snowplow over varying terrain or surfaces.

29. A hinged snowplow for vehicles comprising a support frame having an outwardly extending projection; means for securing said support frame to a vehicle; a pair of generally elongated plow blades; a central hinge having a generally vertical axis; means for securing said plow blades to said hinge one on either lateral side thereof for pivotal movement about said generally vertical axis independent of one another; said hinge including a generally vertical, hinge support member extending rearwardly therefrom and forming a central support for said hinge and blades; a pair of blade positioning arm means for positioning said blades and holding said blades as positioned, each of said arm means extending between said support frame and one of said plow blades; means for pivotally securing each of said arm means to both its respective plow blade and said support frame; said blades being movable between positions forming a forwardly extending V with said central hinge forwardmost to a forwardly open V position having the lateral plow blade edges extending forwardly of said central hinge as well as positions therebetween; horizontal hinge means secured between said hinge support member and said outwardly extending projection for pivotal movement of said central hinge and plow blades about a generally horizontal axis with respect to said support frame, and biasing means for biasing said central hinge and plow blades toward a generally vertically upright position yet allowing said central hinge and plow blades to pivot up and over obstacles encountered during plowing; said hinge means including a pair of hinge plates pivotable about said generally horizontal axis, one of said hinge plates secured to said outwardly extending projection of said support frame, the other hinge plate secured to said hinge support member, said generally horizontal hinge axis being spaced outwardly of the end of said projection, said hinge support member being cut away below said one hinge plate to provide clearance space allowing pivotal movement of said central hinge and plow blades.

30. The hinged snowplow of claim 29 wherein said biasing means includes a pneumatic cylinder having a movable piston, a compressible fluid forcing said piston toward one end of said cylinder, and a shaft connecting said piston to said hinge support member above said horizontal hinge means, the other end of said cylinder being pivotally secured to said support frame whereby when said hinged snowplow pivots about said generally horizontal axis, said fluid is compressed by movement of said shaft and piston and urges said piston toward said other cylinder end to return said hinged snowplow to its upright position.

31. The hinged snowplow of claim 29 wherein said biasing means include a spring extending between said support frame and a portion of said hinge support member located above said horizontal hinge means.

32. The hinged snowplow of claim 29 wherein said biasing means includes a shaft projecting upwardly from said one hinge plate and through an aperture in said other hinge plate, said shaft being curved in an arc concentric with said generally horizontal axis, a coil spring mounted coaxially over said curved shaft and bearing against the top of said other hinge plate, and abutment means secured to the free end of said curved shaft for holding said coil spring on said shaft and against said one hinge plate.

33. A plow for vehicles comprising a support frame; means for securing said support frame to a vehicle; an elongated plow blade; means for attaching said plow blade to said support frame; and plow blade extension means for increasing the length of said plow blade; said extension means including a second plow blade, said second plow blade having a contour matching that of the front surface of said first plow blade; means for securing said first and second blades in overlying relationship to one another; said second plow blade being adapted to extend beyond the free end edge of said first plow blade or be withdrawn such that it is generally coterminous with said first plow blade and being secured such that it overlies the front surface of said first blade; said securing means for said second plow blade including flange means adjacent the upper and lower edges of said blades for limiting and restraining movement of said second plow blade outwardly away from the front surface of said first plow blade, said flange means adjacent said lower edges of said blades including a guide channel projecting outwardly from said front surface of said first blade at a position spaced above the bottom edge of said first blade, and extending along the bottom of said second blade, upwardly a short distance above the lower edge of said second blade and in front of said second blade, said second blade being shorter than said first blade and terminating above the lower edge of said first blade within said guide channel, said guide channel providing sufficient space to allow movement of said second blade parallel to said first blade for extension but restraining movement of the lower edge of said second blade outwardly away from said front surface of said first blade.

34. The plow of claim 33 wherein said securing means for said second plow blade include means for slidably mounting said second plow blade on said first blade, said lower edge of said second blade being slidable within said guide channel.

35. The plow of claim 34 including motive power means for sliding said second plow blade outwardly of the free end edge of said first plow blade.

36. The plow of claim 35 wherein said motive power means include a double direction acting fluid cylinder mounted on the rear surface of said first plow blade adjacent the top edge thereof, said cylinder having a piston for moving an extendible shaft, said extendible shaft being connected to the outer end of said second plow blade, and means for directing fluid to and from each side of said piston in said cylinder.

37. A plow for vehicles comprising a support frame; means for securing said support frame to a vehicle; an elongated plow blade; means for attaching said plow blade to said support frame; and plow blade extension means for increasing the length of said plow blade; said extension means including a second plow blade, said second plow blade having a contour matching that of the front surface of said first plow blade; means for securing said first and second blades in overlying relationship to one another; said second plow blade being adapted to extend beyond the free end edge of said first plow blade or withdrawn such that it is generally coterminous with said first plow blade and being secured such that it overlies the front surface of said first blade; said securing means for said second plow blade including means limiting movement of said second plow blade outwardly away from the front surface of said first plow blade; a plurality of projections on the front surfaces of said first plow blade, each projection having an enlarged head spaced from the front surface of the first plow blade; said second plow blade including a plurality of apertures therethrough in locations corresponding to the positions of said headed projections on said first plow blade, each of said apertures having an enlarged area slightly larger than the size of said projection heads and a slot area extending upwardly from said enlarged area and having a width less than that of said projection heads, each of said projections being received through one of said enlarged aperture areas and into a slot area for retention of said second blades on said first blades; said heads on said projections preventing outward movement of said second blades away from said first blades.

38. A plow for vehicles comprising a support frame; means for securing said support frame to a vehicle; an elongated plow blade; means for attaching said plow blade to said support frame; and plow blade extension means for increasing the length of said plow blade; said extension means including a second plow blade, said second plow blade having a contour matching that of the front surface of said first plow blade; means for securing said first and second blades in overlying relationship to one another; said second plow blade being adapted to extend beyond the free end edge of said first plow blade or withdrawn such that it is generally coterminous with said first plow blade and being secured such that it overlies the front surface of said first blade; said securing means for said second plow blade including means limiting movement of said second plow blade outwardly away from the front surface of said first plow blade and means for slidably mounting said second plow blade on said first blade having a flange extending along the top of said second plow blade for slidingly supporting said second blade along the top edge of said first plow blade; guide means on the front surface of said first plow blade for guiding the sliding movement of said second plow blade along said first; and an end flange on said second plow blade forming a stop limiting inward movement of said second plow blade toward the center of said first blade.

39. A plow for vehicles comprising a support frame; means for securing said support frame to a vehicle; an elongated plow blade; means for attaching said plow blade to said support frame; and plow blade extension means for increasing the length of said plow blade; said extension means including a second plow blade, said second plow blade having a contour matching that of the front surface of said first plow blade; means for securing said first and second blades in overlying relationship to one another; said second plow blade being adapted to extend beyond the free end edge of said first plow blade or withdrawn such that it is generally coterminous with said first plow blade and being secured such that it overlies the front surface of said first blade; said securing means for said second plow blade including means for limiting movement of said second plow blade outwardly away from the front surface of said first plow blade; and means for slidably mounting said second plow blade on said first blade; and motive power means for sliding said second plow blade outwardly of the free end edge of said first plow blade including a single direction acting fluid cylinder mounted on the rear surface of said first plow blade adjacent the top edge thereof, said cylinder having a piston for moving an extendible shaft, said extendible shaft being connected to the outer end of said second plow blade, and means for directing fluid to and from one side of said piston within said cylinder; biasing means for biasing said second plow blade inwardly of the free end edge of said first plow blade.

40. A kit for coverting a vehicular snowplow having a rigid, elongated plow blade to one having a hinged plow blade, said rigid plow blade being of the type having an arcuate cross section with the snow engaging surface being concave, said vehicular snowplow being of the type including a support for supporting said plow blade generally centrally of the rear nonsnow-engaging surface thereof and a pair of blade positioning arms extending between the rear surface of said plow blade and said support, said kit comprising: a template having an arcuate edge for marking the surface of the rigid, elongated plow blade on either side of the blade center line in preparation for cutting the blade along such marks; generally vertically extending hinge means for securing between the portions of said plow blade after it is cut along said marks, said hinge means including generally vertically extending lateral plate means for attachment of the inner end edges of said cut blade portions on either lateral side of said vertical hinge means, a generally vertically and rearwardly extending hinge support means for centrally supporting said hinge means and plow blade portions on a support extending outwardly to a vehicle; and a pair of bracket means for attachment to the rear surface of said plow blade portions for pivotally securing the ends of said blade positioning arms and for forming a stop limiting pivotal movement of said plow blade portions toward said snowplow support when that support is attached to said generally vertical hinge means.

41. The kit of claim 40 wherein said hinge support means includes a planar, vertical hinge support plate extending generally the entire vertical height of said hinge means and rearwardly therefrom and having a rearwardly opening slot for receiving said snowplow support therein.

42. The kit of claim 41 wherein said lateral plate means include blade support plates for each of said blades, said blade support plates extending laterally to either side of said hinge, generally rearwardly from said hinge at an angle to the hinge end of the respective plow blade, and rigidly secured to said hinge end, and pivotally secured to said hinge; a first pair of braces for securement respectively between each of said blade support plates and the rear surface of said respective blade portions; and a second pair of braces for securement between said snowplow support and either side of said hinge support plate.

43. The kit of claim 42 wherein said hinge means includes a cone-shaped foot at the bottom thereof adapted to correspond to cut away areas provided at the hinge ends of said plow blade portions, a central axle having a plurality of collars rotatably mounted thereon between said cone-shaped foot secured at the bottom of said axle and a top securing plate secured at the top of said axle; said hinge support plate being rigidly secured to said foot and the exterior of a first set of said collars; one of said blade support plates being secured to a second set of said collars; the other blade support plate being secured to a third set of said collars; each of said collar sets including at least two collars spaced apart along said axle and alternating with the collars from said other two sets whereby said blades are individually pivotable about said axle.

44. The kit of claim 41 including a pair of springs and means for securing said springs between said hinge support plate and the rear surfaces of said plow blade portions respectively, said springs adapted to bias said blade portions against the force of fluid cylinders when included in said positioning arms.

45. The kit of claim 44 wherein said snowplow is of the type which further includes a single direction acting fluid cylinder in each of said positioning arms, hydraulic means for providing fluid power to said cylinders to extend pistons in said cylinders including a hydraulic pump, fluid conduit means for directing hydraulic fluid to and from said cylinders, first valve means for controlling hydraulic fluid flow through said conduit means to both of said cylinders, said first valve means having at least two positions including a first position in which fluid is directed to one of said cylinders while fluid is allowed to flow from the other cylinder and a second position in which fluid is directed to the other of said cylinders while fluid is allowed to flow from said one cylinder; said kit further including a second valve means for insertion in the fluid conduit means extending to one of said cylinders, said second valve means having two positions including a first position allowing fluid flow to said one cylinder and a second position preventing fluid flow to or from said one cylinder and including means for controlling the position of said second valve means independently of the hydraulic pump and the position of the first valve means.

46. The kit of claim 40 including second hinge means for attachment generally horizontally between said hinge support means and the support for said vehicular snowplow to allow pivotal movement of said hinged plow blade about a generally horizontal axis to avoid obstacles struck by the plow blade and biasing means for attachment between said hinge support means and the support for said snowplow to bias said hinged snowplow toward a generally vertically upright position.

47. The kit of claim 40 including plow blade extension means for increasing the length of at least one of the plow blades between which said central hinge is secured, said extension means including a second plow blade, said second plow blade having a contour matching that of said first plow blade; means for securing said first and second blades in overlying relationship to one another; said second plow blade being adapted to extend beyond the free end edge of said first plow blade or withdrawn such that it is generally coterminous with said first plow blade.

48. A method for converting a vehicular snowplow having a rigid, elongated plow blade to one having a hinged plow blade comprising the steps of:

(1) providing a template for marking the rigid, elongated plow blade for cutting to receive a central, vertical hinge;

(2) marking said blade on either side of the longitudinal center line thereof with said template and cutting said blade into two sections;

(3) providing a hinge having lateral plate means for supporting said blade sections on either side of said hinge and hinge support means extending vertically along the height of said hinge for supporting the hinge and blade sections on a generally horizontal support adapted to be secured to a vehicle; and (4) securing the inner ends of said blade sections to said lateral plate means and said hinge support means to said support.

49. The method of claim 48 further including the step of securing a bracket having engagement means for limiting the pivotal movement of said blade portions about said hinge toward said support to the rear surface of each of said blade sections on either side of said hinge generally at the level of said support and pivotally securing a blade positioning arm between each of said brackets and said support.

50. The method of claim 48 wherein said blade sections are concave in cross section; providing said template with a curved edge for marking said blade portions for cutting to receive said lateral plate means; and marking said blade with said curved template, cutting said blade along said curved markings and securing said lateral plate means to said blade portions cut along said curved markings.

51. The method of claim 48 including providing said hinge support means with an outwardly opening slot, securing said snowplow support in said slot, and securing braces at an angle between said hinge support means and said snowplow support.

* * * * *

UNITED STATES PATENT AND TRADEMARK OFFICE

CERTIFICATE OF CORRECTION

PATENT NO. : 4,074,448

DATED : February 21, 1978

INVENTOR(S) : W. WALLY NIEMELA

It is certified that error appears in the above-identified patent and that said Letters Patent are hereby corrected as shown below:

Column 1, Line 16:

After "use" insert --with--.

Column 6, Line 2:

Before "58b" insert --58a,--.

Column 6, Line 9:

"blade" should be --blades--.

Column 10, Line 39:

"179" should be --170--.

Column 15, Line 31:

After "said" insert --plow--.

Column 22, Line 45:

"coverting" should be --converting--.

Signed and Sealed this

Tenth Day of October 1978

[SEAL]

*Attest:*

RUTH C. MASON
*Attesting Officer*

DONALD W. BANNER
*Commissioner of Patents and Trademarks*